United States Patent [19]

Hulet

[11] 4,154,218

[45] May 15, 1979

[54] ADJUSTABLE COOKING SURFACE

[76] Inventor: Alvin D. Hulet, Aladdin Rt. Box 209, Colville, Wash. 99114

[21] Appl. No.: 858,089

[22] Filed: Dec. 7, 1977

[51] Int. Cl.[2] ..... F24C 15/10

[52] U.S. Cl. ..... 126/215; 126/214 C

[58] Field of Search ..... 126/215, 214 C, 24; 108/1, 136; 126/211, 39 B, 50, 24

[56] References Cited

U.S. PATENT DOCUMENTS

| | | | |
|---|---|---|---|
| 950,119 | 2/1910 | Ruby | 126/215 |
| 990,102 | 4/1911 | Brewer | 126/215 |
| 1,292,782 | 1/1919 | Horikawa | 126/24 |
| 1,362,319 | 12/1920 | Jakobb | 144/288 R |
| 1,805,923 | 5/1931 | Robinson | 126/215 |
| 2,257,398 | 9/1941 | Parker | 126/214 C |
| 2,394,574 | 2/1946 | Wells | 126/24 |
| 2,475,499 | 7/1949 | Hearst | 126/50 |
| 2,520,412 | 8/1950 | Jensen | 126/24 |
| 2,678,643 | 5/1954 | Williams | 126/214 C |
| 2,693,176 | 11/1954 | Spiers | 126/24 |
| 2,871,848 | 6/1955 | Wall | 126/215 |
| 3,288,130 | 11/1966 | Pollock | 126/215 |

*Primary Examiner*—Carroll B. Dority, Jr.
*Assistant Examiner*—Lee E. Barbett
*Attorney, Agent, or Firm*—Wells, St. John & Roberts

[57] ABSTRACT

A leveling device enables adjustable positioning of cooking pans on stove burners where the stove is offset from the horizontal. The device includes first and second annular members that are fitted together for relative rotation on the stove surface. The first annular member includes a recess and first surface that receives a projection and second surface of the second annular member. The surfaces are planar and juxtaposed so that both members may be rotated freely. The surfaces are angularly inclined with respect to a support surface of the second member. By rotating the two annular members relative to one another and the stove framework, the upper member can be selectively adjusted to bring the support surface into a horizontal orientation. Handles are provided on the two members to facilitate relative rotation while a pan rests on the support surface.

4 Claims, 3 Drawing Figures

ADJUSTABLE COOKING SURFACE

BACKGROUND OF THE INVENTION

The present invention relates basically to the field of pan supports for stove burners and more particularly to such supports that may be selectively adjusted to level a pan in relation to an inclined stove top surface.

A non-level cooking surface on a stove causes uneven heating in the foods being prepared. When frying, as an example, an inclined frypan will cause the cooking oil to move to one side of the pan. Food at the opposite side of the frypan will stick and burn while food submerged within the cooking oil will become saturated and not cook properly. Home cooking ranges often include self-leveling or adjusting features for leveling the entire stove surface from the floor supports. Therefore, there is not often a problem in setting and maintaining a typical kitchen stove in a proper level orientation. However, cooking stoves used in recreational vehicles, mobile homes, campers, and other portable installations often require level adjustment. Adjustment of floor support adjusting elements can sometimes be utilized to adjust the level of the cooking surfaces each time the associated vehicle is parked on different terrain or the stove is relocated. However, the adjustment process is slow and tedious. It therefore becomes desirable to obtain some form of apparatus that will enable quick, easy adjustment of the support surface for the cooking pans regardless of the angular orientation of the stove cooking surface.

DETAILED DESCRIPTION OF A PREFERRED EMBODIMENT

Figure 1:
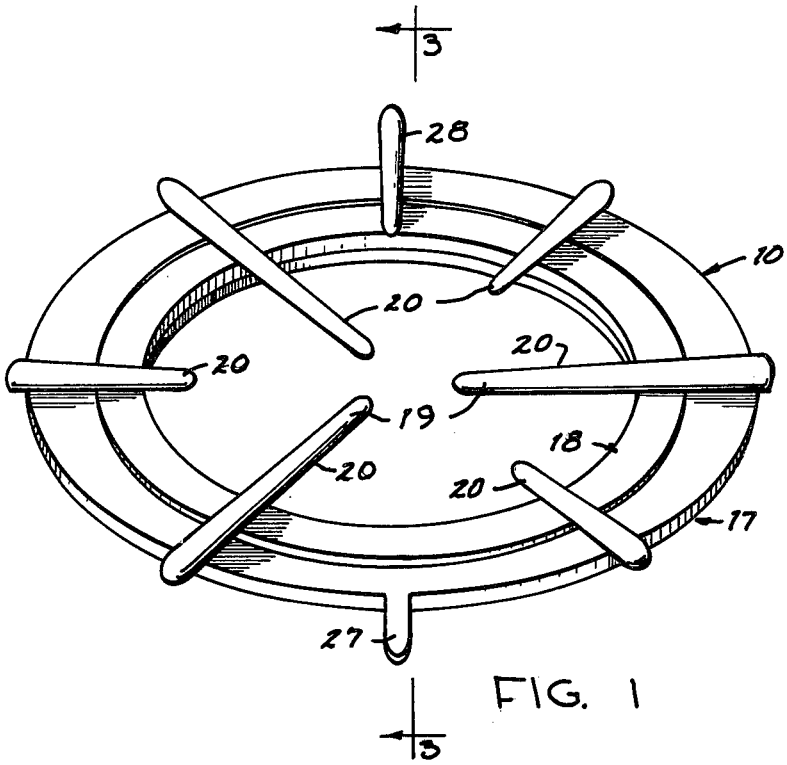
FIG. 1 is a pictorial view of the present device.

The preferred form of the present invention is illustrated in the accompanying drawings and is generally designated therein by the reference character 10. The device 10 is utilized to support cooking receptacles in level orientation with respect to a non-level cooking stove.

Figure 2:
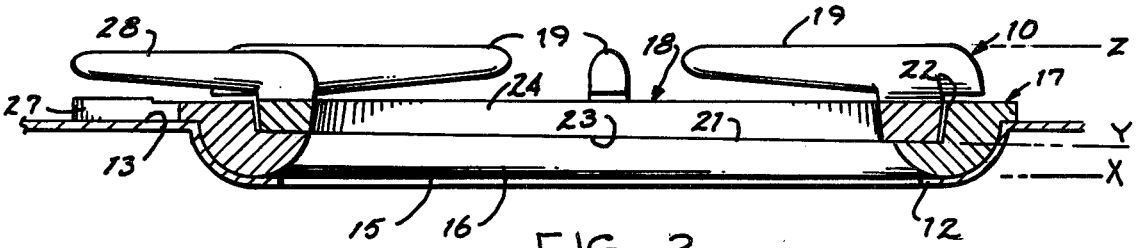
FIG. 2 is a sectional view through the device showing it mounted on a stove top.
Figure 3:
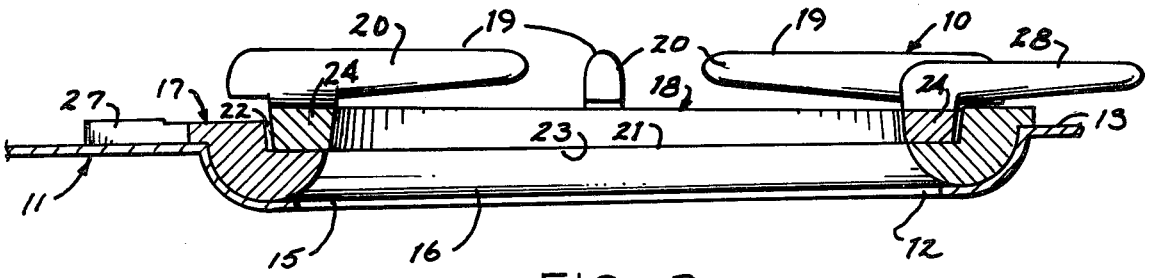
FIG. 3 is a sectional view similar to FIG. 2, but taken along line 3—3 in FIG. 1.

A portion of a stove is designated at 11 in FIGS. 2 and 3. The present device 10 is shown mounted within a burner opening 12 of the stove 11. In FIG. 2 the stove top surface 13 is in a horizontal orientation while in FIG. 3 the surface 13 is inclined. The present device is operable to hold a pan in relation to the stove surface 13 so that regardless of the angular orientation (within reasonable limits) of the surface 13, the pan may be supported horizontally. This is accomplished through manual adjustment of the device which will be described in detail below.

The device 10 includes a downward facing support surface 15 that may be received by the stove at a burner recess or, it may be placed directly upon a flat burner surface such as an electrical resistance coil. The surface 15 is simply comprised of a closed semitoroidal rim 16. The curved surface of rim 16 enables reception of the device by any standard burner opening 12. Further, the semitoroidal configuration lies along a plane and thus enables the device to rest easily on any flat surface. A reference plane passing along the bottom of the toroidal rim 16 is indicated in FIG. 2 at X for the purposes of later description.

Rim 16 is an integral part of a base or first annular member 17. The first annular member 17 includes a first surface 21 located within a recess 22. The first surface 21 is planar and the plane in which it lies is designated by the reference line Y.

Member 17 rotatably receives a cooking support or second annular member 18. A support surface 19 is provided on the second member 18 for holding cooking pans elevationally above the remainder of the device. The surface 19 is comprised of a series of radially oriented ribs 20. These ribs extend outward over the first annular member 17 and inwardly toward the center of the circular space defined by the two rims. It will be noted that the ribs 20 are integral with the second member 18 and do not come into contact with the first member 17. This enables free rotational movement of the second member relative to the first. For the purposes of later description, the plane in which the support surface 19 lies is designated by the reference line Z.

Second annular member 18 includes a second surface 23 that is formed at the bottom of an annular projection 24. The projection 24 is complementary to the recess 22 and surfaces 23 and 21 are juxtaposed in a freely slidable relationship. Therefore, the plane of the second surface 23 is coplanar with the plane of first surface 21. This plane, since it is juxtaposed with the plane of surfaces 21, will also be referred to as the Y plane.

The first annular member 17 includes a radially projecting handle 27. Second member 18 includes a similar radially projecting handle 28. It will be noted in FIG. 2 that the handles 27 and 28 are elevationally spaced so as not to interfere with one another during rotational movement of one member relative to the other. Handles 27, 28 protrude substantially outward from the periphery of the respective members 17, 18 to allow free access to a user when a pan is supported on the surface 19. Handles 27, 28 enable one to rotate one or both members 17, 18 relative to one another and relative to the stove framework.

Now with reference to the planes X, Y and Z briefly described above, the plane X of toroidal rim 16 is inclined with respect to the plane Y of surface 21. Similarly, the plane of support surface 19 is angularly oriented or inclined by an identical angle of inclination with respect to the plane Y of surface 23. Therefore, rotation of the respective members 17 and 18 relative to one another will change the angular relationship of the support surface 19 to the plane X. Preferably, the device is placed so the plane X is parallel to the plane of the stove surface 13.

The inclination of the planes Y relative to the respective surface planes X and Z are only moderate so the weight of a pan will not cause the surfaces 21 and 23 to slip undesirably. For example, I have found that a total adjustable elevational change of ¼ inch from one side of the device to the other is ordinarily sufficient.

If the stove surface is horizontal as shown in FIG. 2, the members 17 and 18 may be rotated to such a position wherein the support surface 19 is also horizontal and parallel with the stove surface 13. However, if the stove surface is not level, as shown in FIG. 3, the two members 17, 18 may be rotated until a horizontal orientation is found. This may be easily done with a partially liquid-filled pan resting on the support surface 19. With this arrangement, the user may simply turn the members 17, 18 until the liquid appears level within the pan. The stove is then ready for use.

Because both members 17, 18 are rotatable, the plane of inclination between the top and bottom surfaces of the two elements can be oriented in any angular position about their common axis on the stove franework. The device therefore allows one to level the cooking surface by providing means for varying the inclination between the surfaces indicated as planes X and Z (relative rotation of elements 17, 18) as well as means for angularly aligning this plane of inclination (rotation of elements 17, 18 as a unit relative to the stove framework).

It is noted that the above description and drawings are given merely to set forth the preferred form of the invention. Only the following claims are intended to set forth restrictions on the scope of my invention.

What I claim is:

1. An adjustable cooking surface device for a cook stove, comprising:

a base member having planar lower surface means thereon for engagement upon a cook stove framework; said base member having a first planar annular surface formed thereon facing oppositely to said lower surface means;

a cooking support member having planar upper surface means thereon for engagement by cooking implements; said cooking support having a second planar annular surface formed thereon facing oppositely to said upper surface means;

said first and second planar annular surfaces, being complementary and in sliding engagement with one another for relative coaxial angular movement between said base member and said cooking support member;

said first and second planar annular surfaces being in planes inclined relative to the planar lower surface means and planar upper surface means, respectively, by angles of inclination identical to one another, whereby relative coaxial angular movement between said base member and cooking support member will position the planar upper surface means parallel to the planar lower surface means or at a selected angle thereto limited by the angles of inclination of said first and second planar annular surfaces.

2. An adjustable cooking surface device as set out in claim 1 wherein said cooking support member further comprises:

a handle fixed thereto and extending outward beyond its periphery.

3. An adjustable cooking surface device as set out in claim 1 wherein said base member further comprises:

a handle fixed thereto and extending outward beyond its periphery.

4. An adjustable cooking surface device as set out in claim 1 wherein said cooking support member and said base member each further comprise:

a handle fixed thereto and extending outward beyond its periphery, whereby coaxial angular movement can be imparted to either the base member or cooking support member relative to one another and relative to a cook stove framework engaged by said base member.

* * * * *